US011939788B2

(12) United States Patent
Kefallinos et al.

(10) Patent No.: US 11,939,788 B2
(45) Date of Patent: Mar. 26, 2024

(54) FENCE PANEL HAVING TABS AND METHOD OF INSTALLATION THEREOF

(71) Applicants: Constantinos Kefallinos, Rosemere (CA); Nicolaos Kefallinos, Laval (CA)

(72) Inventors: Constantinos Kefallinos, Rosemere (CA); Nicolaos Kefallinos, Laval (CA)

(73) Assignee: Constantinos Kefallinos, Rosemere (CA)

( * ) Notice: Subject to any disclaimer, the term of this patent is extended or adjusted under 35 U.S.C. 154(b) by 65 days.

(21) Appl. No.: 17/457,157

(22) Filed: Dec. 1, 2021

(65) Prior Publication Data

US 2022/0170289 A1 Jun. 2, 2022

Related U.S. Application Data

(60) Provisional application No. 63/119,752, filed on Dec. 1, 2020.

(51) Int. Cl.
*E04H 17/14* (2006.01)

(52) U.S. Cl.
CPC ..... *E04H 17/1426* (2013.01)

(58) Field of Classification Search
CPC ..... E04F 11/1848; E04F 11/1861; E04F 2011/1831; E04H 17/1417; E04H 17/1426; E04H 17/143; E04H 17/1439; E04H 17/16; E04H 17/164; E04H 17/165; E04H 17/166; E04H 17/17; E04H 17/1602
USPC ..... 256/1, 19, 22, 23, 24, 34, 73
See application file for complete search history.

(56) References Cited

U.S. PATENT DOCUMENTS

| | | | | |
|---|---|---|---|---|
| 3,636,669 | A * | 1/1972 | Attkisson | E04H 17/16 52/510 |
| 6,719,276 | B1 * | 4/2004 | Bush | E04H 17/16 256/1 |
| 7,185,864 | B2 * | 3/2007 | Adams | A47G 25/0614 248/304 |
| 7,207,551 | B2 * | 4/2007 | Fielden | E04H 17/1602 256/22 |
| 7,997,560 | B2 * | 8/2011 | Bergdoll | E04H 17/16 256/24 |
| 8,910,404 | B2 * | 12/2014 | Ruybal | G09F 7/18 40/606.03 |
| 9,809,994 | B1 * | 11/2017 | Neff | E04H 17/1602 |
| 10,156,084 | B2 * | 12/2018 | Garcia | E04H 17/143 |
| D859,695 | S * | 9/2019 | Crawford | A47G 25/0614 D25/151 |

(Continued)

FOREIGN PATENT DOCUMENTS

| | | | | |
|---|---|---|---|---|
| GB | 2054692 A | * | 2/1981 | E04H 17/1434 |
| GB | 2296730 A | * | 7/1996 | E04H 17/16 |
| GB | 2416549 A | * | 2/2006 | E04H 17/165 |

*Primary Examiner* — Josh Skroupa
(74) *Attorney, Agent, or Firm* — Brouillette Legal Inc.; Robert Brouillette

(57) ABSTRACT

A fence panel configured to occupy an opening between adjacent pickets of a fence, the fence panel comprising a primary panel, a suspension panel extending substantially horizontally from an upper portion of the primary panel and above a rail of the fence, a vertical portion extending downwardly from the suspension panel behind the rail, a horizontal tab configured to wrap about the rail, at least one flange extending from the primary panel and at least one vertical tab extending from the at least one flange and configured to wrap about a picket.

20 Claims, 5 Drawing Sheets

(56) References Cited

U.S. PATENT DOCUMENTS

| | | | | |
|---|---|---|---|---|
| 2016/0298357 | A1* | 10/2016 | Liu | E04H 17/1417 |
| 2017/0081873 | A1* | 3/2017 | Crawford | E04H 17/165 |
| 2021/0123241 | A1* | 4/2021 | Meyer | E04H 17/1417 |

* cited by examiner

FIG. 1 – PRIOR ART

FENCE PANEL HAVING TABS AND METHOD OF INSTALLATION THEREOF

CROSS-REFERENCE TO RELATED APPLICATIONS

The present patent application claims the benefits of priority of U.S. Provisional Patent Application No. 63/119,752, entitled "FENCE PANEL HAVING TABS AND METHOD OF INSTALLATION THEREOF", and filed at the United States Patent Office on Dec. 1, 2020, the content of which is incorporated herein by reference.

FIELD OF THE INVENTION

The present invention generally relates to the field of fencing accessories and methods of installation thereof and, more particularly, to the field of panels to be installed in between adjacent pickets of a fence and to the methods of installation thereof.

BACKGROUND OF THE INVENTION

Various forms of fencing are commonly used as barriers or railings which may serve multiple functions. In residential and commercial settings, fences may offer a level of privacy and security by preventing trespassing or theft. Fences may additionally be used to keep children or pets from wandering away.

Fences in these settings are typically constructed using vertical posts and pickets structurally adjoined by horizontal rails. These elements are commonly spaced apart leaving open gaps in between adjacent components which may allow passersby to view through the fencing, smaller animals or children to pass across. Such gaps additionally offer little protection from wind or precipitation. Moreover, the gaps allow others to see through the fence and thus having a limited privacy level.

There is therefore a need for a fence panel capable of restricting and minimizing the open gaps in a fence.

SUMMARY OF THE INVENTION

The aforesaid and other objectives of the present invention are realized by generally providing a fence panel configured to occupy an opening between adjacent pickets of a fence. The fence panel generally comprises a primary surface and a suspending system extending substantially horizontally from an upper portion of the primary panel and above a rail of the fence. The fence panel further comprises a vertical portion extending downwardly from the suspension panel behind the rail and a horizontal tab configured to wrap about the rail. The panel further comprises at least one flange extending from the primary panel and at least one vertical tab extending from the at least one flange and configured to wrap about a picket.

The present invention is further directed to a fence panel for covering an opening between adjacent pickets of a fence, the fence panel comprising a covering member comprising two flanges extending at an angle from each lateral edge of the covering member, and a plurality of attaching tabs extending from each of the flanges of the covering member each of the tabs being bendable around a portion of each of the adjacent pickets, the unbended tabs extending in the same plane as the flanges.

In certain embodiments, the suspending member may be suspendable from an upper rail of the fence and the suspending member may comprise a first portion extending at an angle from the covering member and a second portion extending downwardly from the first portion. The second portion may further comprise a tab foldable to wrap about the upper rail and at least one of a slot and perforations.

In other embodiments, each of the attaching members may be a vertical wrappable tab extending from a lateral edge of the covering member, with the vertical tab being foldable. The wrappable tab may extend from a flange extending perpendicularly from the covering member. The fence panel may further comprise a flange extending from the side of the covering member, wherein the flange extends from the covering member in a direction substantially perpendicular to the covering member.

In further embodiments still, the fence panel may further comprise a flange extending from a bottom portion of the fence panel and the covering surface may comprise an aperture.

The present invention is further directed to a method of covering a fence, the method comprising aligning lateral flanges extending at an angle from a fence panel between adjacent pickets of the fence, and bending one or more tabs extending in the same plane as the flanges around each of the adjacent pickets to attach the fence panel to the adjacent pickets.

In certain embodiments, suspending the upper portion may comprise suspending a support surface of an attachment system atop the rail, and positioning a downward portion of the attachment system behind the rail, wherein suspending the upper portion may further comprise bending a horizontal tab of the vertical portion about a bottom portion of the rail. Bending the horizontal tab may comprise bending about a slotted section of the vertical portion, wherein attaching the lower portion may comprise bending one or more tabs around the adjacent pickets.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE INVENTION

A novel fence panel having tabs and method of installation thereof will be described hereinafter. Although the invention is described in terms of specific illustrative embodiment(s), it is to be understood that the embodiment(s) described herein are by way of example only and that the scope of the invention is not intended to be limited thereby.

Figure 1:
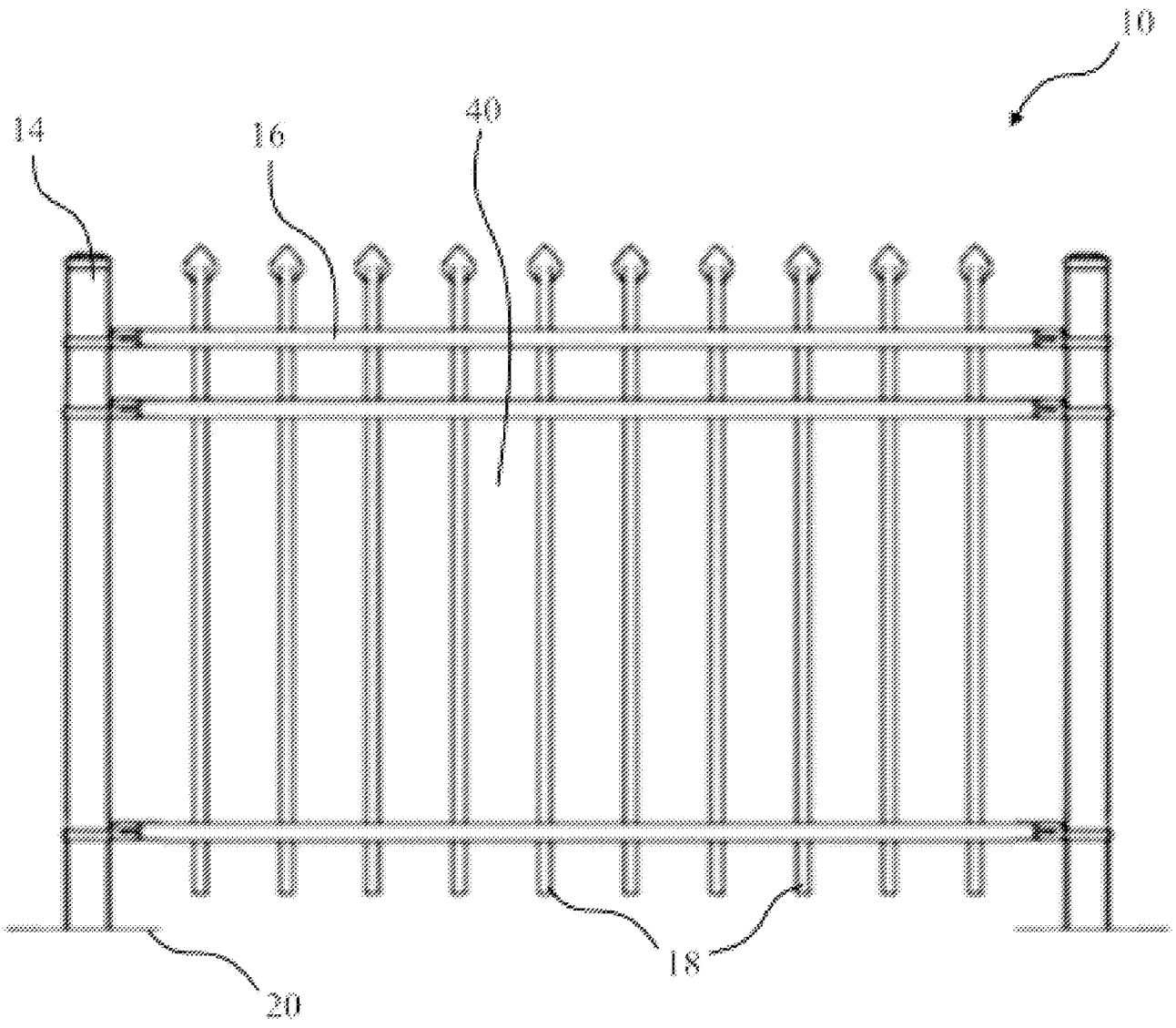
FIG. 1 is a front elevation view of a prior art fence.

Referring to FIG. 1, a prior art fence 10 is illustrated. The fence 10 comprises posts 14 which are typically anchored in the ground or any rigid surface 20 to provide a structural foundation to the fence 10. The fence 10 generally comprises rails 16 which run horizontally along the fence 10 to adjoin the posts 14, and pickets 18 which fill the space in between adjacent posts 14 to fulfill the primary functions of the fence 10, namely to prevent the passing of individuals, animals or objects across the fence. As may be appreciated, the spacing between adjacent pickets 18 and posts 14 creates a plurality of openings 40.

Referring now to FIGS. 2 to 5, a fence panel 100 in accordance with the principles of the present invention is illustrated. Broadly, the fence panel 100 is configured to be installed onto the fence 10 in order to limit or entirely cover the openings 40. To that end, the fence panel 100 may comprise a primary surface 120 having a width 122 being substantially similar or smaller than the spacing between adjacent pickets 18 and posts 14.

The fence panel 100 may be made of any suitable rigid or semi-rigid material such as, but not limited to, aluminum, steel, fiberglass or plastic.

In certain embodiments, the fence panel 100 may comprise an attachment system 140, generally located at an upper portion 104 of the fence panel 100. In the embodiment illustrated in the FIGS. 2 to 5, the attachment system 140 is located at the top extremity 105 of the upper portion 104 of the support surface 120. In some embodiments, the attachment system 140 may comprise a support surface 142 extending or protruding substantially horizontally from the primary panel 120 and configured to suspend or attach the fence panel 100 upon a rail 16 of the fence 10. To that end, the support surface 142 may have a depth being similar or larger than the depth of the rail 16.

Figure 3:
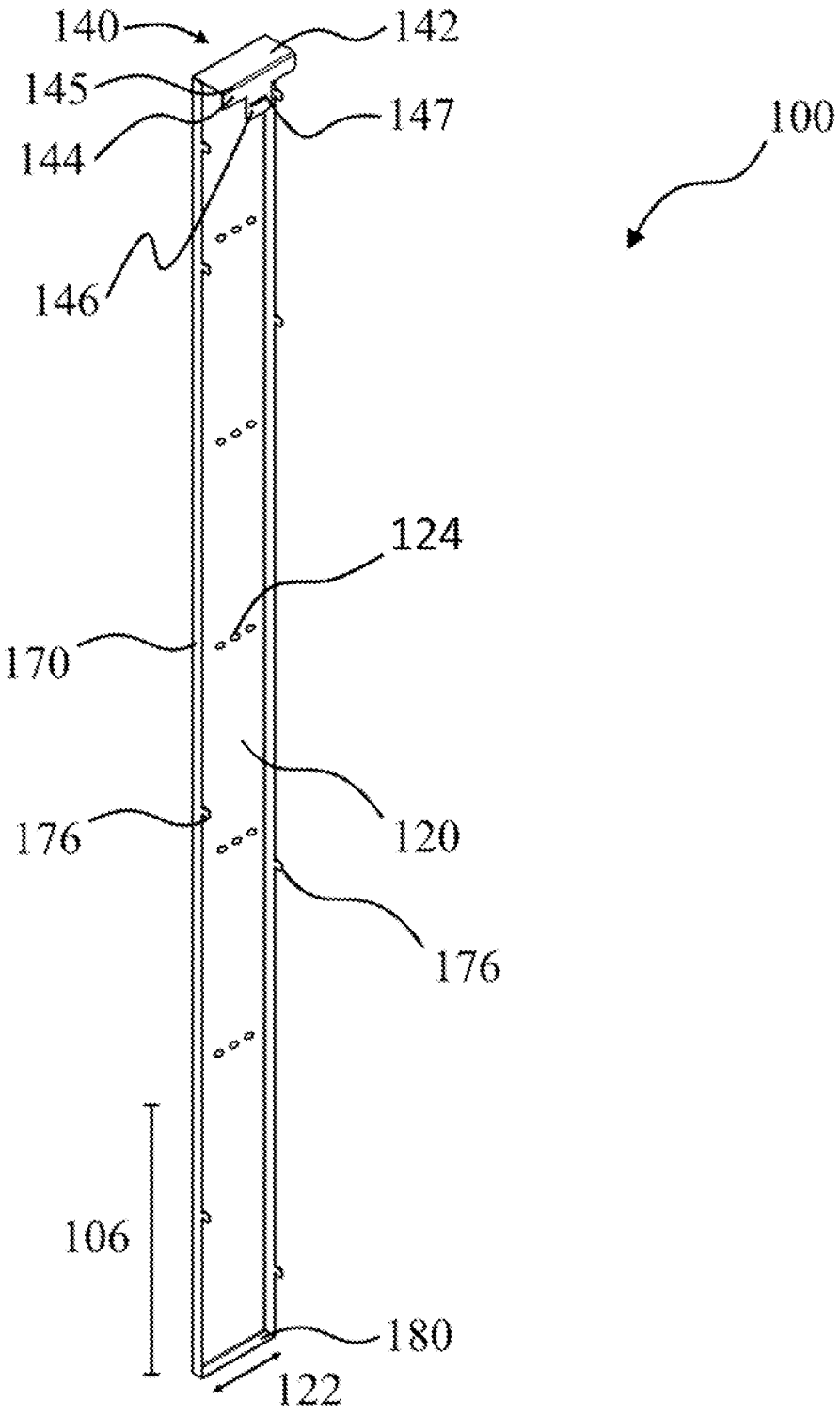
FIG. 3 is a rear perspective view of the fence panel of FIG. 2.
Figure 4:
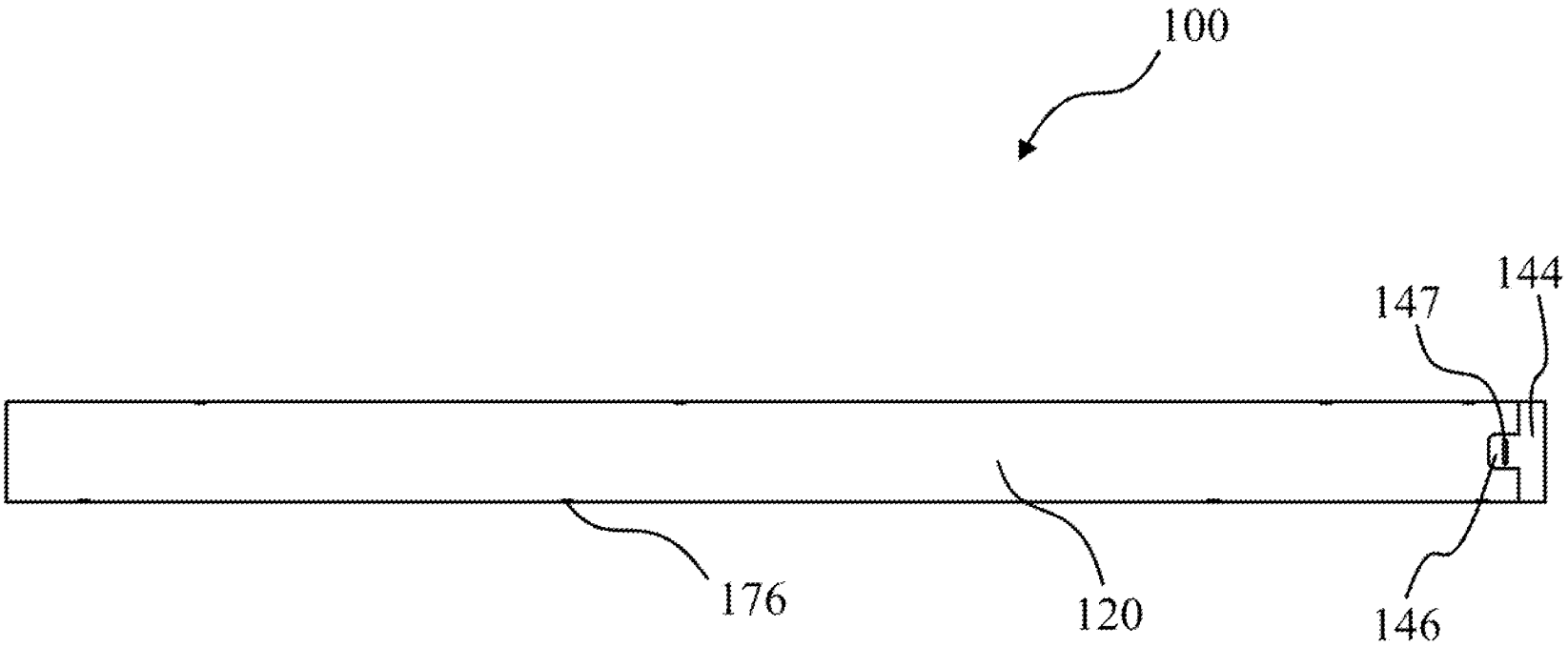
FIG. 4 is a rear elevation view of the fence panel of FIG. 2.
Figure 5:
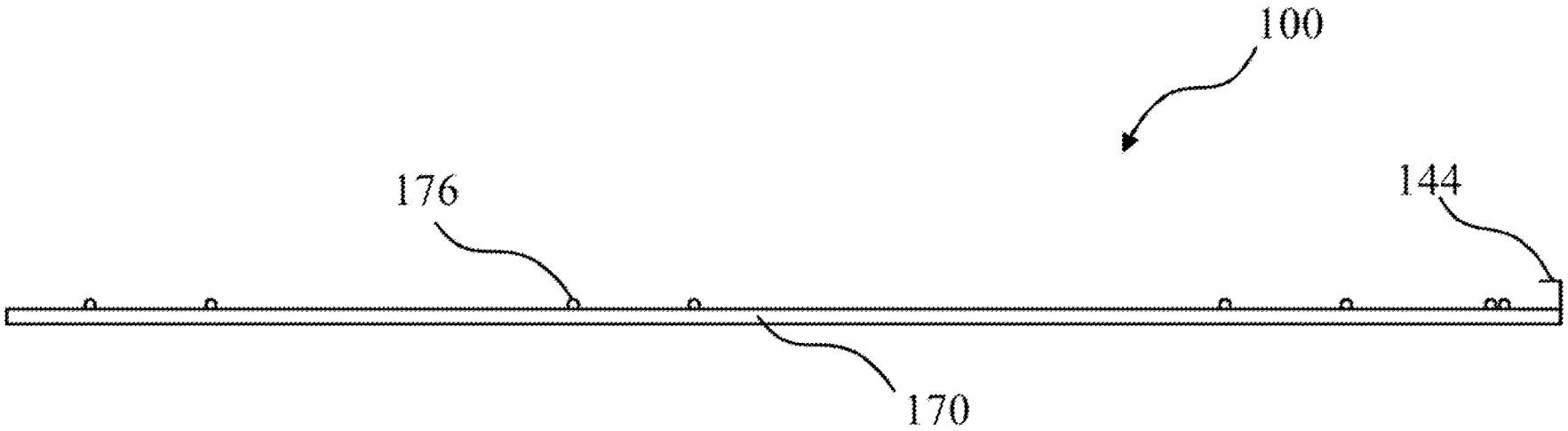
FIG. 5 is a side elevation view of the fence panel of FIG. 2.

Referring now to FIGS. 3 and 4, the attachment system 140 may additionally comprise a vertical portion 144 extending or protruding substantially downwardly from the support surface 142 in order to prevent horizontal displacement of the fence panel 100 when it is installed on the rail 16. In some embodiments, the vertical portion 144 may extend or protrude from the outer extremity 145 of the support surface 142.

In further embodiments, the attachment system 140 may further comprise a horizontal tab 146. In some embodiments, the horizontal tab 146 projects downwardly from the vertical portion 144. The horizontal tab 146 is generally configured to be bent about a horizontal axis with limited effort by hand or using a tool. To that end, a pivot axis 147 of the horizontal tab 146 may be slotted or perforated to reduce the moment required to bend the horizontal tab 146. The horizontal tab 146 is configured to be bent under the rail 16 such as to affix the fence panel 100 to the rail 16. Accordingly, the height of the horizontal tab 146 should be less than the depth of the support surface 142.

Figure 2:
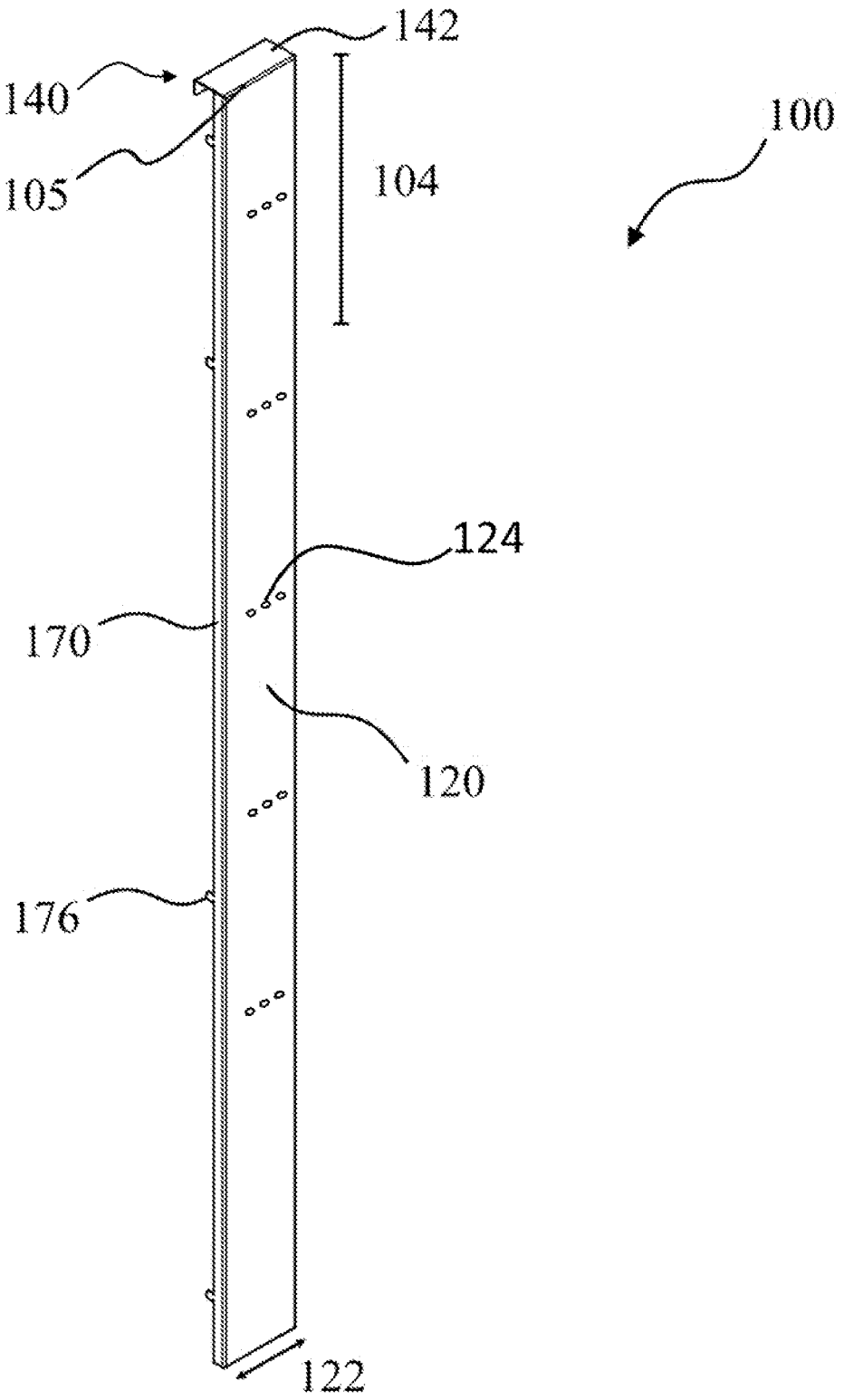
FIG. 2 is a front perspective view of an exemplary fence panel in accordance with the principles of the present invention.

The fence panel 100 may also comprise one or more flanges 170. The flanges 170 generally aim at increasing the structural integrity of the fence panel 100 and at preventing flexion. In a preferred embodiment, the flanges 170 project from fence panel 100 in a horizontal direction being similar to that of the attachment system 140. Referring now to FIGS. 2 and 3, in such embodiment, the fence panel 100 comprises two vertical flanges 170 located on vertical ends of the fence panel 100 and a horizontal flange 180 located at a lower portion 106 of the fence panel 100. In certain embodiments, the ends of the flanges 170 and the horizontal flange 180 may be further connected such as, for example, by welding.

The fence panel 100 may further comprise one or more vertical tabs 176, typically projecting from the vertical flanges 170. The vertical tabs 176 are configured to be bent about a substantially vertical axis with limited effort, such as by hand or using a tool. The vertical tabs 176 are additionally configured to be bent about the pickets 18 such as to further affix the fence panel 100 to the fence 10. Accordingly, the depth of the vertical flanges 170 should be similar or greater than the depth of the pickets 18 thus allowing the axis of rotation of the vertical tabs 176 to be unobstructed. Understandably, any other method of fixing the panel 100 to the pickets 18, such as but not limited to, fasteners, brackets, rope, etc., may be used within the scope of the present invention.

In certain embodiments, the primary surface 120 may comprise one or more apertures 124. The apertures 124 may allow a desirable quantity or light or ventilation to pass across the primary panel 120 while still preventing general visibility or children and animals to pass across the fence 10. The apertures 124 may have any desired or suitable shape.

The present invention also provides a method for installing a fence panel 100 onto a fence 10. The method comprises a step of aligning the fence panel 100 within a spacing or opening 40 between two adjacent pickets 18 of the fence 10 or between a post 14 and an adjacent picket 14. The method further comprises suspending the fence panel 100 to a rail 16. In some embodiments, the step of suspending the fence panel 100 may further comprise placing a support surface 142 over a top portion of the rail 16. The suspending of the fence panel 100 may further comprise attaching the fence panel 100 to an outer wall of the rail 16. In some embodiments, attaching the fence panel 100 to the other wall comprises surrounding the top of the rail and at least a part of the outer side wall of the rail with the support surface 142 and the vertical surface 144. The suspending of the fence panel 100 may further comprise attaching the fence panel 100 to a bottom wall of the rail 16. In some embodiments, the fence panel 100 is suspended to the bottom wall of the rail 16 by bending a horizontal tab 146 about a bottom portion of the rail 16.

The method may further comprise the step of attaching the fence panel 100 to one or more adjacent pickets 18 to affix the fence panel 100 to the fence 10. In some embodiments, attaching the fence panel 100 to the one or more adjacent pickets 18 comprises bending one or more vertical tabs 176 around the adjacent pickets 18.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A fence panel for covering an opening between adjacent pickets of a fence, the fence panel comprising:

a covering member comprising two flanges extending at an angle from each lateral edge of the covering member; and a plurality of attaching tabs extending from each of the flanges of the covering member, each of the tabs being bendable around a portion of each of the adjacent pickets, the unbended tabs extending in the same plane as the flanges.

2. The fence panel of claim 1 further comprising a suspending member being suspendable from an upper rail of the fence.

3. The fence panel of claim 2, wherein the suspending member comprises:

a first portion extending at an angle from the covering member; and a second portion extending downwardly from the first portion.

4. The fence panel of claim 3, wherein the second portion further comprises a tab foldable to wrap about the upper rail.

5. The fence panel of claim 3, wherein the second portion comprises at least one of a slot and perforations.

6. The fence panel of claim 1, the tab being outwardly bendable around a portion of the one of the adjacent pickets.

7. The fence panel of claim 1, the two flanges extending perpendicularly from each lateral edge of the covering member.

8. The fence panel of claim 1 further comprising a flange extending from a bottom portion of the fence panel.

9. The fence panel of claim 1, the attaching tabs comprising a slotted section allowing bending.

10. The fence panel of claim 9, the slotted section being adjacent to the covering member.

11. The fence panel of claim 1, wherein the fence panel is an add-on to the existing fence.

12. The fence panel of claim 1, the covering member comprising a top portion adapted to abut against a top rail of the fence and a bottom portion adapted to abut against a bottom portion of a bottom rail of the fence.

13. The fence panel of claim 1 further comprising a flange extending from a top portion of the covering member.

14. A method of covering a fence, the method comprising:

aligning lateral flanges extending at an angle from a fence panel between adjacent pickets of the fence; and bending one or more tabs extending in the same plane as the flanges around each of the adjacent pickets to attach the fence panel to the adjacent pickets.

15. The method of claim 14 further comprising suspending an upper portion of the fence panel onto a rail of the fence.

16. The method of claim 15, wherein suspending the upper portion comprises suspending a support surface of an attachment system atop the rail.

17. The method of claim 16, wherein suspending the upper portion further comprises positioning a downward portion of the attachment system behind the rail.

18. The method of claim 17, wherein suspending the upper portion further comprises bending a horizontal tab of the downward portion about a bottom portion of the rail.

19. The method of claim 18, wherein bending the horizontal tab comprises bending about a slotted section of the downward portion.

20. The method of claim 14, the lateral flanges extending at perpendicularly from the fence panel.

* * * * *